US007612732B2

(12) United States Patent
Takeishi et al.

(10) Patent No.: US 7,612,732 B2
(45) Date of Patent: Nov. 3, 2009

(54) ANTENNA WITH STRIPLINE SPLITTER CIRCUIT

(75) Inventors: Kei Takeishi, Tokyo (JP); Seiji Nishi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 25 days.

(21) Appl. No.: 12/000,810

(22) Filed: Dec. 18, 2007

(65) Prior Publication Data

US 2008/0180329 A1 Jul. 31, 2008

(30) Foreign Application Priority Data

Jan. 31, 2007 (JP) ..... 2007-021814

(51) Int. Cl.
*H01Q 21/00* (2006.01)
*H01Q 1/38* (2006.01)

(52) U.S. Cl. ..... 343/853; 343/700 MS

(58) Field of Classification Search ..... 343/850, 343/853, 895, 700 MS
See application file for complete search history.

(56) References Cited

U.S. PATENT DOCUMENTS 3,747,114 A * 7/1973 Shyhalla ..... 343/795
2001/0028325 A1* 10/2001 Pretorius et al. ..... 343/700 MS
2004/0004576 A1* 1/2004 Anderson ..... 343/770
2004/0040576 A1* 3/2004 Sun et al. ..... 134/6
2008/0316097 A1* 12/2008 Mckinley et al. ..... 342/368

FOREIGN PATENT DOCUMENTS

JP 07-297630 11/1995
JP 2004-200833 7/2004
WO WO 2006/132032 A1 12/2006

OTHER PUBLICATIONS

Seiji Nishi et al. "Development of Millimeter-Wave Video Transmission System—Development of Antenna," Proc. 2001 Asia-Pacific Microwave Conf., vol. 2, pp. 509-512, Dec. 2001.

* cited by examiner

*Primary Examiner*—Rexford N Barnie
*Assistant Examiner*—Dylan White
(74) *Attorney, Agent, or Firm*—Rabin & Berdo, PC

(57) ABSTRACT

A flat antenna includes a 2×2 array of circular waveguide antenna elements that receive power from a splitting circuit including first to fourth striplines. The second stripline extends in two directions from one end of the first stripline. The third stripline extends in two directions from one end of the second stripline. The fourth stripline extends in two directions from the other end of the second stripline. Four feeder electrodes extend in mutually identical directions from the ends of the third and fourth striplines into the waveguides. The third and fourth striplines are bowed in way that shifts the second stripline closer to the center of the array. This arrangement permits a compact spacing of the waveguide antenna elements.

7 Claims, 10 Drawing Sheets

ANTENNA WITH STRIPLINE SPLITTER CIRCUIT

BACKGROUND OF THE INVENTION

1. Field of the Invention

The present invention relates to an antenna having a stripline splitter circuit.

2. Description of the Related Art

Stripline splitter circuits are employed in flat antennas to feed signal power to an array of antenna elements. Flat antennas of this type are useful in, for example, wireless communication systems that link computing devices or other electronic devices within a building.

A flat antenna described by Yamami in Japanese Patent Application Publication No. 7-297630 (paragraphs 0013-0017 and FIG. 1) has an array of antenna elements formed in a flat dielectric body. The splitter circuit is a network of feeder lines laid out between the antenna elements to carry signal power to and from the antenna elements. The layout is plane-symmetrical, symmetrically equivalent parts of the splitter circuit being aligned in the direction of the electric field generated by the antenna elements. The power feed point of the splitter circuit is offset from the plane of symmetry by one-fourth of the effective wavelength of the transmitted or received signal in the electric field direction. This allows the electric fields of the individual antenna elements to reinforce each other while causing unwanted electrical couplings between symmetrical pairs of antenna elements and power lines to cancel out, thereby reducing the occurrence of sidelobes in the field plane and improving the directional symmetry of the electric field.

Another flat antenna, described by Nishi et al. in 'Development of Millimeter-Wave Video Transmission System, Development of Antenna' (proc. 2001 Asia-Pacific Microwave Conf., Vol. 2, pp. 509-512, December 2001), has an 8×8 array of circular waveguides 3.2 mm in diameter that radiate or receive signals in the 66-GHz band. The splitter circuit is formed in a dielectric substrate sandwiched between the upper and lower halves of the body of the antenna.

FIG. 1 illustrates, in plan view, the splitter circuit in a 2×2 antenna unit in this flat antenna, indicating the positions of four radiating elements 1-4, four striplines 11-14, and four feeder electrodes 21-24 in a Cartesian coordinate system with X and Y axes. One end of the first stripline 11 is joined to the second stripline 12 at a branching point P1 in the middle of the second stripline 12. The two ends of the second stripline 12 are joined to the third and fourth striplines 13, 14 at branching points P2, P3 in the middles of those striplines 13, 14. The ends of the third stripline 13 are joined to the ends of feeder electrodes 21, 22 which extend in the negative Y direction into the first and second radiating elements 1, 2. The ends of the fourth stripline 14 are joined to the ends of feeder electrodes 23, 24 which extend in the negative Y direction into the third and fourth radiating elements 3, 4.

FIG. 2 shows two adjacent antenna units U1, U2 with an alternative layout in which the feeder electrodes 21, 22, 23, 24 extend in the negative X direction. The first striplines 11 of both antenna units receive power from an input stripline 10 at an input branching point P0.

A requirement of the splitter circuits in FIGS. 1 and 2 is that the four paths from the input stripline to the radiating elements 1-4 via the first, second, and third branching points P1, P2, P3 must have equal power splitting ratios and uniform phase delays. Basically, this means that the four branched stripline paths must have equal total electrical lengths. Consequently, the first branching point P1 must be disposed between the first and second radiating elements 1 and 2, which constrains the spacing of the array.

To reduce variations in stripline impedance, and to suppress unwanted radiation caused by stray coupling from the striplines into the waveguide windows that form the radiating apertures of the circular waveguide array antenna, the layout of the striplines on the surface must be properly balanced with respect to the ground plane, which is situated in a separate layer below the striplines. Specifically, the striplines must not approach the edges of the ground plane, which is bored with holes having diameters equal to the diameters of the waveguide windows, too closely.

This condition is met in FIG. 1 as follows: the first and second striplines 11, 12 are straight in the vicinity of the first branching point P1, where they form a T-shaped triple junction; the third and fourth striplines 13, 14 are straight over their entire lengths; the first stripline 11 keeps a distance d1 from the edge of radiating element 2; the second stripline 12 keeps a similar distance d2 from the edge of radiating element 1; the first branching point P1 is offset in the negative X direction from an imaginary line S joining the second and third branching points P2, P3; the imaginary line S coincides with the midline of the array in the Y direction. With these arrangements, the spacing of the radiating elements 1-4 in the array is reducible to 4.1 mm.

In FIG. 2 the above condition is met as follows: the first stripline 11 follows the edge of the first or second radiating element 1 or 2 partway therearound, maintaining a distance d1 from the aperture of the first or second radiating element 1 or 2; the second, third, and fourth striplines 12, 13, 14 are straight in the vicinities of the first, second, and third branching points; the third stripline 13 has terminal parts that follow edges of the first and second radiating elements 1, 2 partway therearound, maintaining predetermined distances d3, d4 from the apertures of the first and second radiating elements 1, 2; the fourth stripline 14 has terminal parts that follow the edges of the third and fourth radiating elements 3, 4 partway therearound, maintaining predetermined distances d3, d4 from the apertures of the third and fourth radiating elements 3, 4; distances d1, d3, and d4 are mutually equal; the first branching point P1 is offset in the negative X direction from an imaginary line S joining the second and third branching points P2, P3. With these arrangements, the array spacing is reducible to 4.4 mm.

The need to maintain the predetermined distances d1, d2, d3, d4 and to provide space for the first branching point between the first and second radiating elements 1, 2 precludes further reductions in the spacing of the radiating elements in these layouts. This has been an obstacle to the improvement of antenna performance.

Accordingly, there has been an unfulfilled need to provide an array antenna with a stripline splitter circuit capable of aligning the phases of power fed to the radiating elements, shortening the electrical path lengths, and narrowing the spacing between radiating elements.

SUMMARY OF THE INVENTION

The invented antenna has at least one antenna unit formed by first, second, third, and fourth radiating elements with respective apertures, disposed in a Cartesian X-Y plane. The first and second radiating elements are mutually aligned in the X direction. The third and fourth radiating elements are mutually aligned in the X direction. The first and third radiating elements are mutually aligned in the Y direction. The second and fourth radiating elements are mutually aligned in the Y direction. Electrical power is fed to these radiating elements by first, second, third, and fourth feeder electrodes that extend in mutually identical directions into the apertures of the first, second, third, and fourth radiating elements, respectively.

The antenna unit also has first, second, third, and fourth striplines that transmit electrical power to the feeder electrodes. The third stripline is connected to the first and second feeder electrodes. The fourth stripline is connected to the third and fourth feeder electrodes.

The first stripline extends from a first branching point on the second stripline toward the second radiating element, then follows the perimeter of the second radiating element partway therearound, maintaining at least a predetermined distance from the aperture of the second radiating element.

The second stripline extends from a second branching point on the third stripline to the first branching point, maintaining at least the predetermined distance from the apertures of the first and second radiating elements, then extends from the first branching point to a third branching point on the fourth stripline. The first branching point is disposed between the first radiating element and an imaginary straight line joining the second and third branching points.

The third stripline has terminal parts that follow the perimeters of the first and second radiating elements partway therearound, maintaining at least the predetermined distance from the apertures of the first and second radiating elements. The fourth stripline has terminal parts that follow the perimeters of the third and fourth radiating elements partway therearound, maintaining at least the predetermined distance from the apertures of the third and fourth radiating elements and the first stripline.

The second branching point is disposed strictly between the first branching point and an imaginary tangent line tangent to the terminal parts of the third stripline.

Compared with the conventional antennas described above, in the invented antenna the second stripline is shifted toward the third and fourth radiating elements, and the third and fourth striplines follow the contours of the radiating elements more closely. As a result, the radiating elements can be placed closer together, giving the antenna designer greater latitude in choosing the spacing of the antenna elements. The more compact spacing permitted by the present invention is helpful in suppressing stray coupling, reducing unwanted radiation, and aligning the phase delays of the antenna elements.

DETAILED DESCRIPTION OF THE INVENTION

Figure 1:
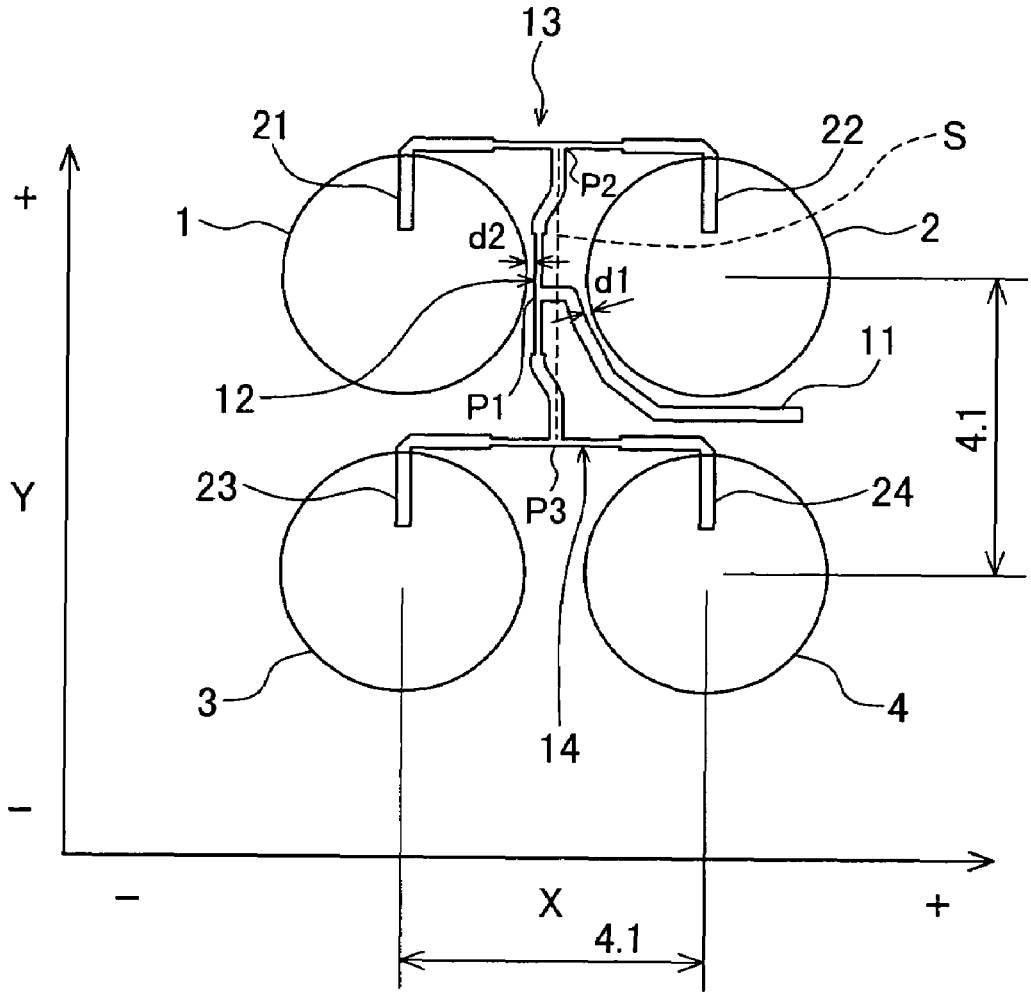
FIG.1 PRIOR ART
FIGS. 1 and 2 show stripline splitter circuits used in conventional flat antennas.

Embodiments of the invention will now be described with reference to the attached drawings, in which like elements are indicated by like reference characters.

First Embodiment

Figure 3:
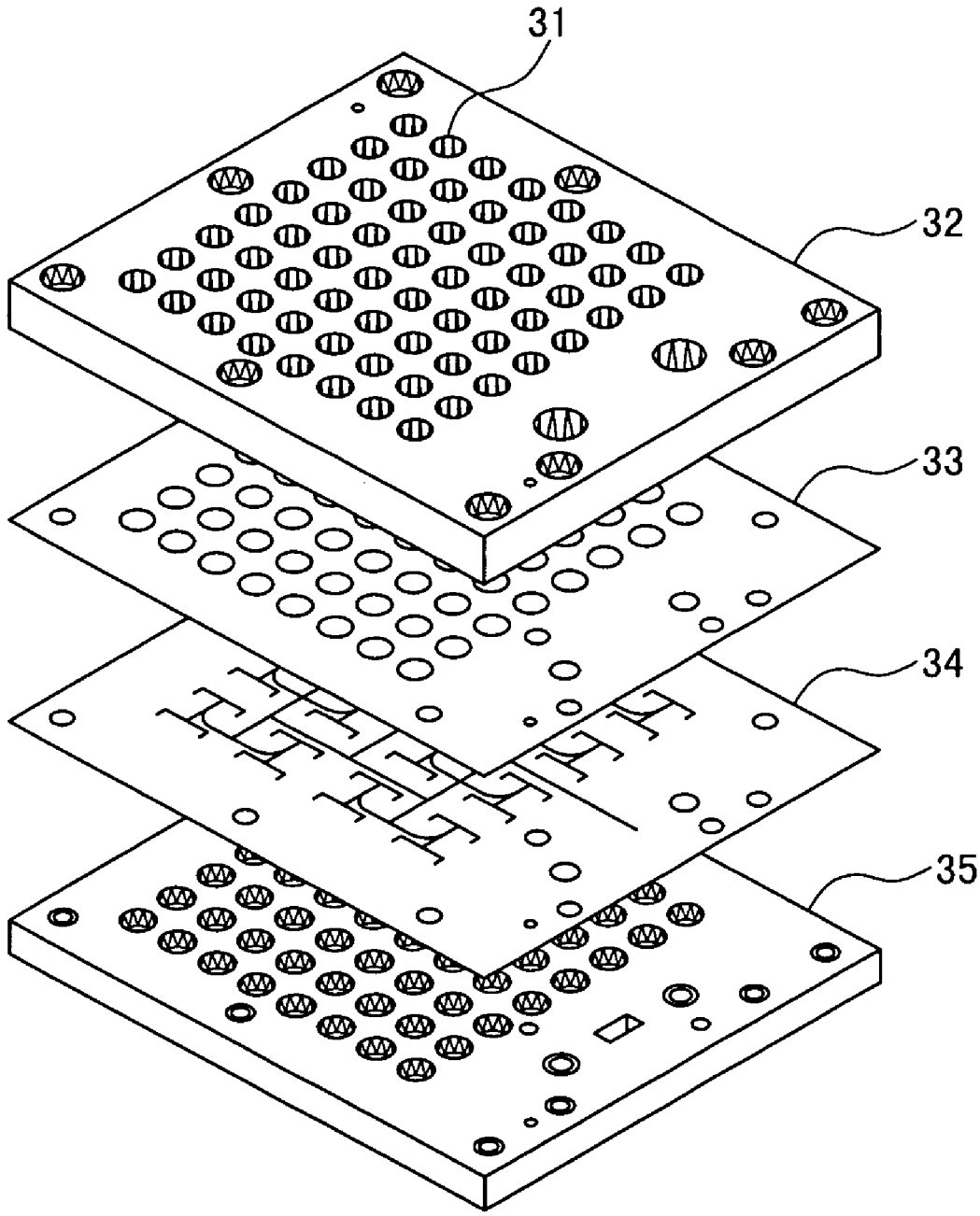
FIG. 3 is an exploded perspective view of an antenna using a stripline splitter circuit according to a first embodiment of the invention.

Referring to FIG. 3, the first embodiment is a flat antenna comprising an equally spaced 8×8 array of circular horn waveguides functioning as radiating elements 31. The radiating elements 31 have 3.2-mm apertures, which is suitable for operation at 66 GHz. The radiating elements 31 are formed in an upper plate 32, which is the radiating surface of the antenna. The antenna also comprises a dielectric substrate 33, a splitter circuit board 34, and a lower plate 35. In transmitting mode, the radiating elements 31 receive signal power in the form of electromagnetic waves from a stripline splitter circuit disposed on the splitter circuit board 34, which is insulated from the upper plate 32 by the dielectric substrate 33. The power is radiated from the tips of feeder electrodes that extend into the circular areas under the radiating elements 31. The lower plate 35 has an array of reflectors that reflect power radiated toward the bottom of the antenna back up toward the apertures of the radiating elements 31, and an opening for feeding power to the stripline splitter circuit from an external signal source.

The stripline splitter circuit on the splitter circuit board 34 is structured so that when supplied with signal power from the opening in the lower plate 35, it transmits identically phased electromagnetic waves to the feeder electrodes of the radiating elements 31. Since the feeder electrodes extend in identical directions into the radiating elements 31 in the upper plate 32, the electric field distributions in the plane of the apertures of the radiating elements 31 are aligned identically, resulting in aligned polarization planes on the upper plate 32.

The part of the stripline splitter circuit that feeds power to an antenna unit comprising a 2×2 sub-array of radiating elements in the 8×8 array will be described below. Like the conventional splitter circuits shown in FIGS. 1 and 2, this splitter circuit transmits power to four radiating elements on stripline paths, each path leading through two branching points. The 8×8 array is made up of sixteen such 2×2 antenna units linked by further straight striplines that can be partially seen on the splitter circuit board 34 in FIG. 3.

Figure 4:
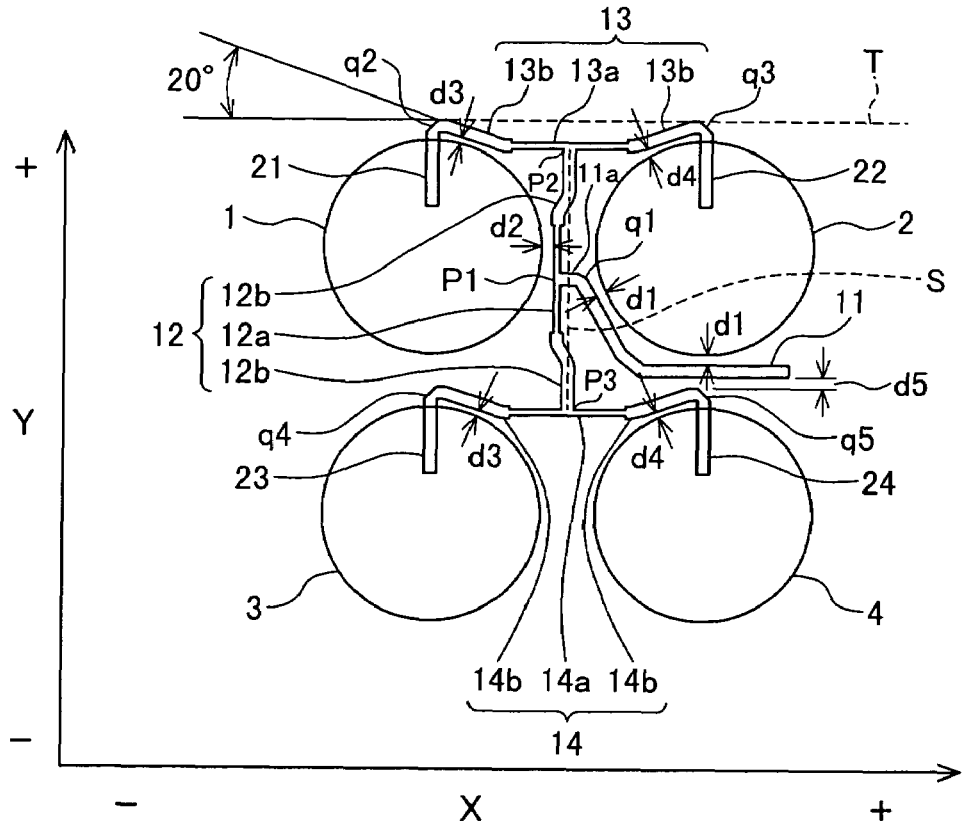
FIG. 4 shows the stripline splitter circuit in the first embodiment.

Referring to FIG. 4, the antenna unit includes four radiating elements 1-4 disposed in a Cartesian X-Y plane. The first and second radiating elements 1, 2 are mutually aligned in the X direction. The third and fourth radiating elements 3, 4 are mutually aligned in the X direction. The first and third radiating elements 1, 3 are mutually aligned in the Y direction. The second and fourth radiating elements 2, 4 are mutually aligned in the Y direction.

The antenna unit also includes feeder electrodes 21-24, all extending identically in the negative Y direction, for feeding power to the first to fourth radiating elements 1-4, and a stripline splitter circuit that transmits power to the feeder electrodes 21-24.

The stripline splitter circuit comprises a first stripline 11, a second stripline 12, a third stripline 13, and a fourth stripline 14. The second stripline 12 extends in the positive and negative Y directions from one end of the first stripline 11 at a first branching point P1 located between the first and second radiating elements 1, 2. The third stripline 13 extends in the positive and negative X directions from one end of the second stripline 12 at a second branching point P2. The fourth stripline 14 extends in the positive and negative X directions from the other end of the second stripline 12 at a third branching point P3. The third stripline 13 has terminal parts 13*b* connected at respective connection points q2, q3 to the feeder electrodes 21, 22 extending into the first and second radiating elements 1, 2. The fourth stripline 14 has terminal parts 14*b* connected at respective connection points q4, q5 to the feeder electrodes 23, 24 extending into the third and fourth radiating elements 3, 4.

The second, third, and fourth striplines 12, 13, 14 include straight central parts 12*a*, 13*a*, 14*a* and terminal parts 12*b*, 13*b*, 14*b*. The straight central parts form the arms of T-shaped triple junctions at the branching points P1, P2, P3. The terminal parts extend obliquely from the ends of the straight central parts.

From the first branching point P1, the first stripline 11 extends straight to a bending point q1 and then follows the perimeter of the aperture of the second radiating element 2 partway therearound, maintaining a predetermined distance d1 from the aperture of radiating element 2.

The second stripline 12 extends in the Y direction for the length of its straight central part 12*a*, maintaining a predetermined distance d2 from the aperture of the first radiating element 1. The terminal parts 12*b* of the second stripline 12 first extend obliquely from the ends of the central part 12*a* toward the third and fourth striplines 13, 14, then straighten and follow an imaginary straight line S to meet the third and fourth striplines 13, 14 at right angles at the second and third branching points P2, P3. The second stripline 12 accordingly has a bowed shape that shifts the first branching point P1 in the negative X direction, as in the conventional antenna shown in FIG. 2. More specifically, the first branching point P1 is disposed between the first radiating element 1 and the imaginary straight line S, which joins the second and third branching points P2, P3.

From the ends of the straight central part 13*a* of the third stripline 13, the terminal parts 13*b* of the third stripline 13 extend obliquely upward in FIG. 4 to follow the perimeters of the first and second radiating elements 1, 2 partway therearound, maintaining predetermined distances d3, d4 from the apertures of radiating elements 1, 2, until they meet feeder electrodes 21, 22. Similarly, from the ends of the straight central part 14*a* of the fourth stripline 14, the terminal parts 14*b* of the fourth stripline 14 extend obliquely upward to follow the perimeters of the third and fourth radiating elements 3, 4 partway therearound, maintaining the predetermined distances d3, d4 from the apertures of radiating elements 3, 4, until they meet feeder electrode 23, 24.

Figure 2:
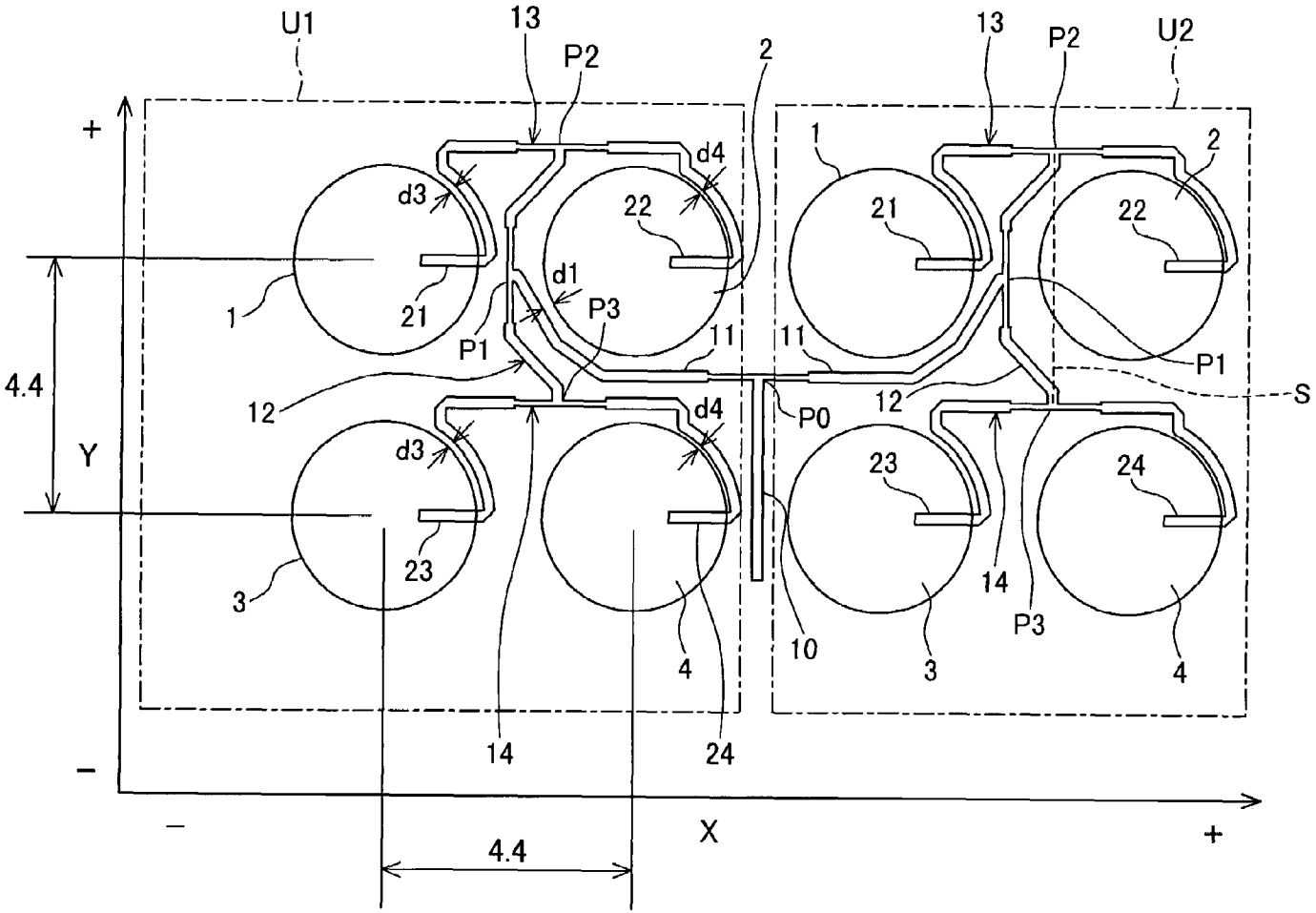
FIG.2 PRIOR ART

The third and fourth striplines 13, 14 therefore also have a bowed shape, instead of the straight shape in the conventional antenna in FIG. 2. As a result, the second stripline 12 as a whole and the first branching point P1 in particular is shifted in the negative Y direction as compared with FIG. 2, and the second branching point P2 is located strictly between the first branching point P1 and an imaginary tangent line T tangent to the terminal parts 13*b* of the third stripline 13 at the connection points q2, q3. Despite the downward shift of the first branching point P1, a predetermined distance d5 is maintained between the first stripline 11 and the terminal part 14*b* of the fourth stripline 14.

Because of the downward shift of the first branching point P1, the first branching point P1 is located where there is more space available between the first and second radiating elements 1, 2 than in the conventional antenna in FIG. 2. This provides the capability to reduce the spacing between the radiating elements in the X direction while still maintaining the necessary separations d1, d2 between the radiating elements and the first and second striplines. In addition, since the first stripline 11 does not have to follow the perimeter of the second radiating element 2 for as long a distance as in the conventional antenna in FIG. 2, the length of the first stripline 11 can be shortened. The amount of shortening can be adjusted by having the first stripline 11 follow the perimeter of the second radiating element 2 more closely or less closely.

Since the terminal parts 13*b*, 14*b* of the third and fourth striplines 13, 14 follow the perimeters of the third and fourth radiating elements 3, 4 more closely, there is also more room to reduce the Y-direction spacing between the radiating elements 1-4. The first embodiment can accordingly produce an antenna that is more compact than the conventional antenna in FIG. 2, while preserving the phase alignment of the power fed to the antenna elements.

Figure 5:
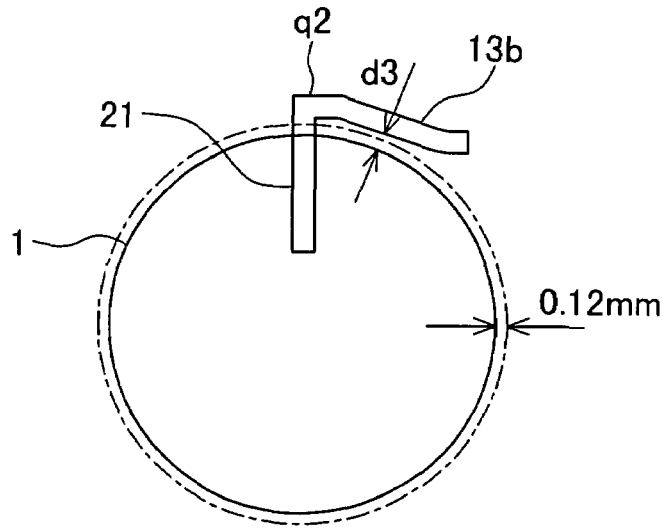
FIG. 5 is an enlarged view of a radiating element and associated striplines in the first embodiment.

FIG. 5 illustrates one of the areas of closest approach between the striplines 11-14 and the radiating elements 1-4, showing the first radiating element 1, the first feeder electrode 21, and the terminal part 13*b* of the third stripline 13. The aperture of the radiating element 1, which has a radius of 1.6 mm, is surrounded by an imaginary concentric circle with a radius larger by 0.12 mm. The third stripline 13 is placed outside this imaginary circle. At the connection point q2, the terminal part 13*b* of the third stripline 13 meets feeder electrode 21 at an angle of 90 degrees. After extending straight away from feeder electrode 21 for a short distance, the terminal part 13*b* of the third stripline 13 slopes downward, making an angle of approximately 20 degrees with the X direction in FIG. 4, to approximately follow the perimeter of the aperture of the radiating element 1.

This same pattern is used at the connection points q3, q4, q5 of the third and fourth striplines 13, 14 with feeder electrodes 22, 23, 24, providing distance margins d1, d2, d4 equal to distance d3. The distance d5 between the first stripline 11 and the terminal part 14*b* of the fourth stripline 14 is also equal to distance d3.

Figure 6A:
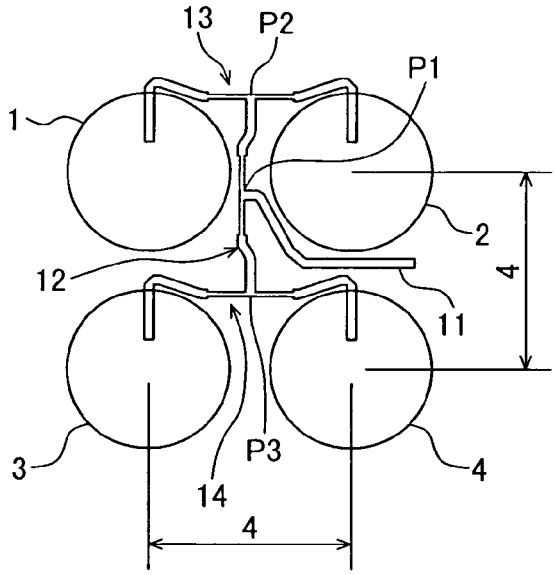
FIG. 6A illustrates antenna element spacing dimensions in the first embodiment.
Figure 6B:
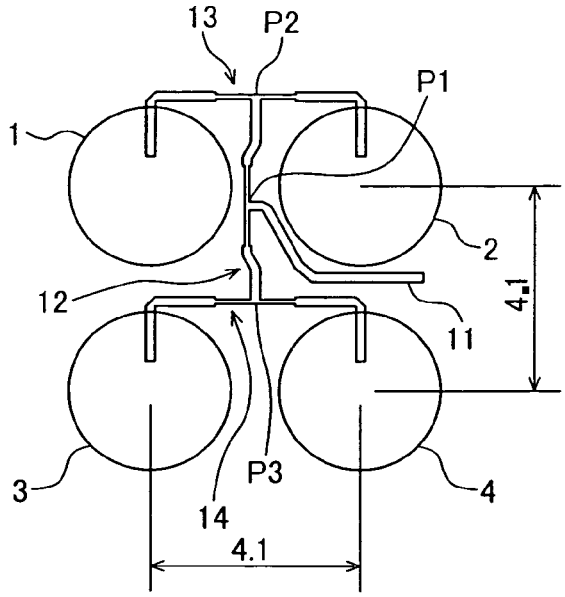
FIG.6B PRIOR ART
FIG. 6B illustrates antenna element spacing dimensions in a similar antenna with a conventional stripline splitter circuit.

When the above distances d1 to d5 all have values of 0.12 mm, the spacing of the radiating elements 1-4 can be reduced to 4.0 mm, as shown in FIG. 6A, instead of the conventional 4.1-mm spacing of an array in which the third and fourth striplines 13, 14 are straight, as shown again in FIG. 6B. In both cases, the striplines 11-14 are 0.2 mm wide, except for the central parts 12*a*, 13*a*, 14*a* of the second, third, and fourth striplines, which are narrower.

Figure 7:
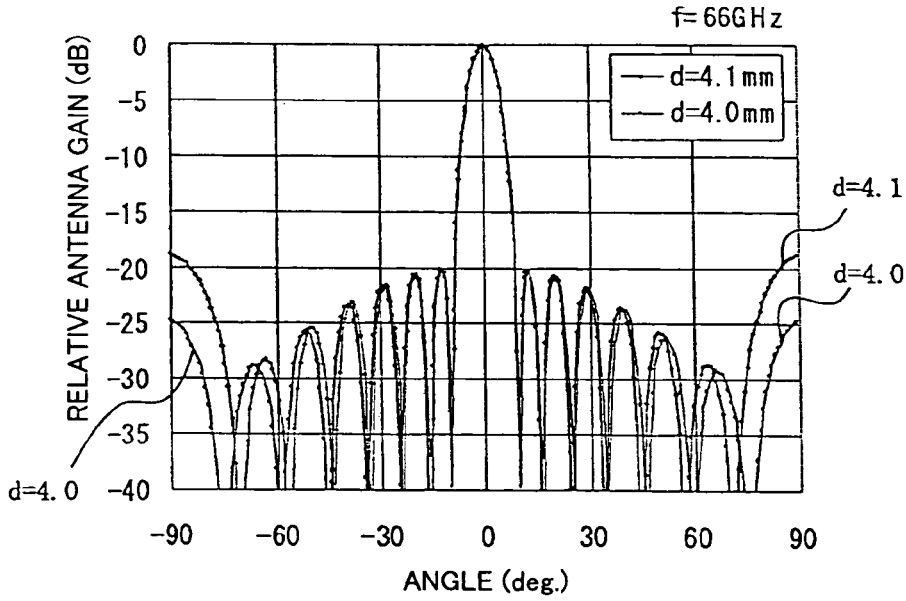
FIG. 7 shows radiation patterns of the antenna in the first embodiment.

FIG. 7 shows calculated radiation patterns of flat antennas with 8×8 arrays of radiating elements having spacings of 4.0 mm, as in the first embodiment, and 4.1 mm, as conventionally. The frequency of the radiated signal is assumed to be 66 GHz.

In the conventional flat antenna with a 4.1-mm spacing, grating lobes exceeding −20 dB occur at 90 degrees and −90 degrees. When the antenna unit of the first embodiment is used, these grating lobes are reduced by approximately 6 dB, to a value considerably less than −20 dB. This is due to the reduction of the array spacing from 4.1 mm to 4.0 mm.

As described above, the first stripline 11 follows the perimeter of the second radiating element 2 partway therearound, approaching the aperture of the second radiating element 2 no closer than a distance d1. The second stripline 12 has a bowed shape with a straight central part 12*a* separated by only a distance d2 from the aperture of the first radiating element 1. The first branching point P1 is thereby offset in the negative X direction. The terminal parts 13*b* of the third stripline 13 follow the perimeters of the first and second radiating elements 1, 2 partway therearound, approaching the apertures of these radiating elements no closer than distances d3 and d4. The terminal parts 14*b* of the fourth stripline 14 follow the perimeters of the third and fourth radiating elements 3, 4 partway therearound, approaching the apertures of these radiating elements no closer than distances d3 and d4. The third and fourth striplines 13, 14 have a bowed shape that shifts the first branching point P1 in the negative Y direction, shortening the first stripline 11 while keeping it separated by a distance of at least d5 from the fourth striplines 14.

Without destroying the phase alignment of the signal power fed to the radiating elements 1-4, this layout enables the spacing of the array of radiating elements 1-4 to be reduced. The increased flexibility in the design of the array spacing makes it possible to reduce unwanted radiation, thereby improving the antenna's operating characteristics and obtaining a wider half bandwidth.

Second Embodiment

Figure 8:
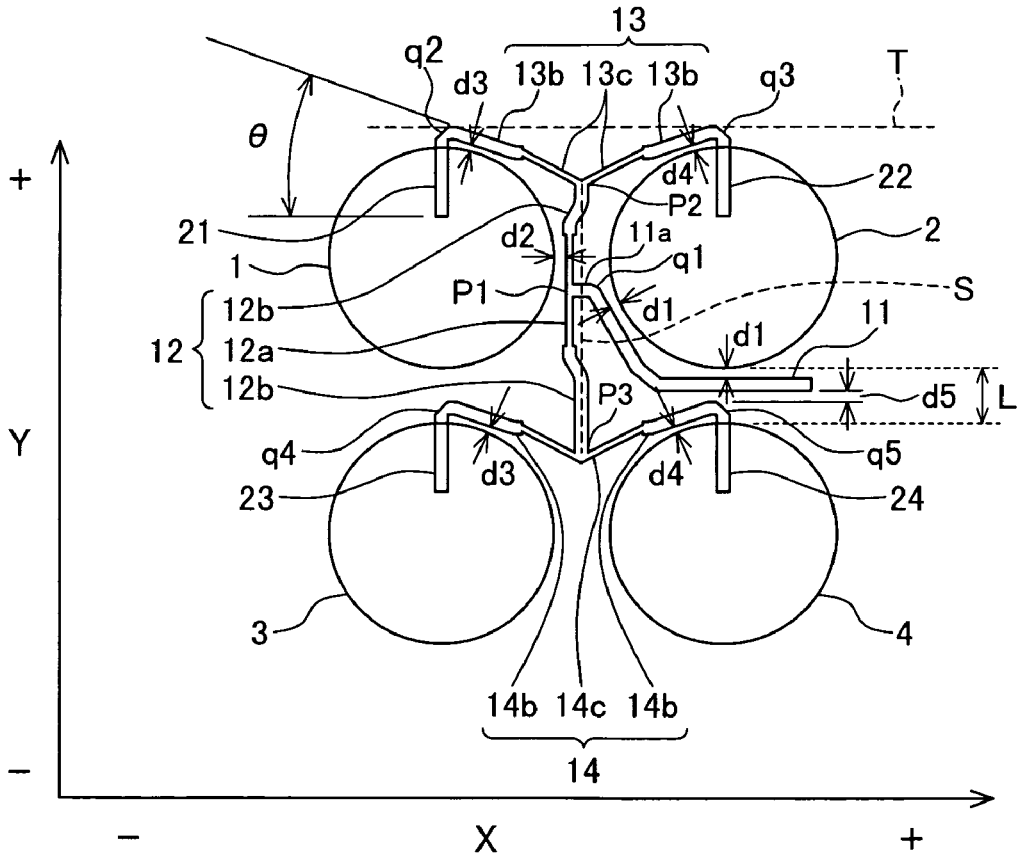
FIG. 8 shows a stripline splitter circuit according to a second embodiment of the invention.

Referring to FIG. 8, the second embodiment is generally similar to the first embodiment, but the first branching point P1 is offset farther in the negative Y direction. Specifically, the central part 13*c* of the third stripline 13 now has a V-shape with an exterior angle met by the second stripline 12 to form a Y-shaped triple junction at the second branching point P2; the central part of the fourth stripline 14 has a V-shape with an interior angle met by the second stripline 12 to form an umbrella-shaped triple junction at the third branching point P3. As a result, the second stripline 12 is shifted farther in the negative Y direction than in the first embodiment. As in the first embodiment, the second branching point P2 is disposed strictly between the first branching point P1 and an imaginary line T tangent to the terminal parts 13*b* of the third stripline 13 at connection points q2 and q3.

Descriptions of other aspects of the layout, which are the same as in the first embodiment, will be omitted.

Distances d1-d5 in FIG. 8, including the distance d1 between the first stripline 11 and the second radiating element 2, the distance d2 between the second stripline 12 and the first radiating element 1, and the distances d3, d4 between the terminal parts 13*b* of the third stripline 13 and the first and second radiating elements 1, 2 and between the terminal parts 14*b* of the fourth stripline 14 and the third and fourth radiating elements 3, 4, are all set identically to 0.1 mm. This is slightly less than the 0.12-mm distance used in the first embodiment. The widths of the striplines 11-14 are 0.2 mm as in the first embodiment.

Figure 9:
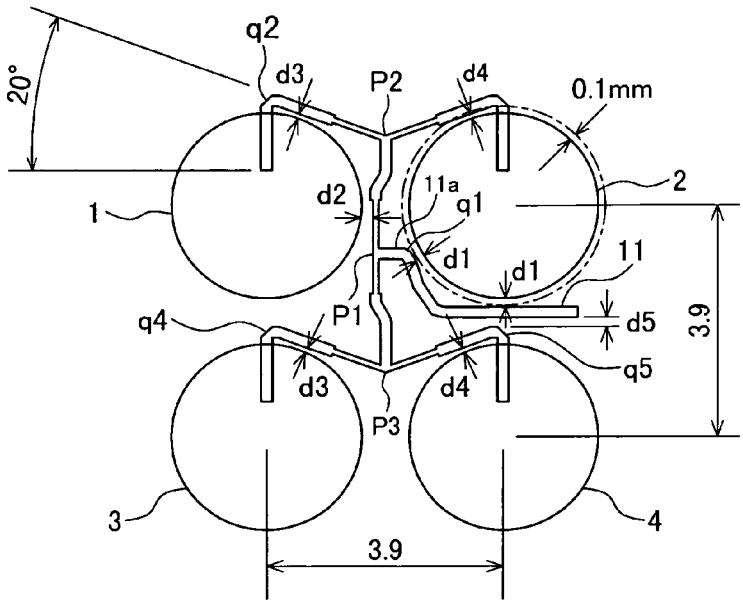
FIG. 9 illustrates angles and spacing dimensions in the second embodiment.

The layout of the second embodiment is further illustrated in FIG. 9. To keep distances d3, d4 of 0.1 mm between the terminal parts 13*b* of the third stripline 13 and the apertures of the first and second radiating elements 1, 2, the terminal parts 13*b* of the third stripline 13 extend at angles of 90 degrees for very short distances from the ends of feeder electrodes 21, 22 at the connection points q2, q3, then slope downward at angles of approximately 20 degrees with respect to the X direction. The central part 13*c* of the third stripline 13 maintains these 20-degree slopes up to the second branching point P2, thereby giving the entire third stripline 13 a V-shape. Similarly, the central part 14*c* of the fourth stripline 14 maintains the slopes of the terminal parts 14*b* up to the third branching point P3, giving the entire fourth stripline 14 a V-shape.

Figure 10A:
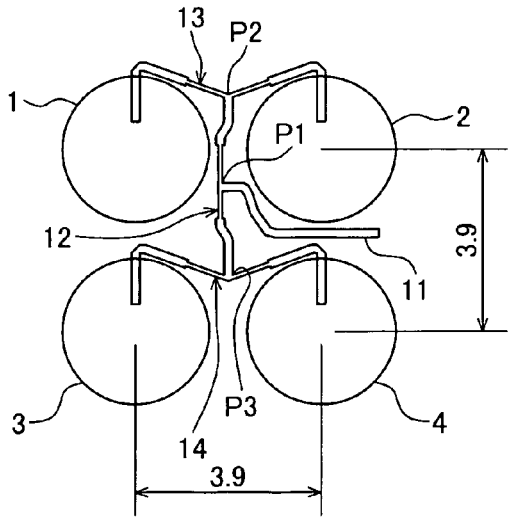
FIG. 10A illustrates antenna element spacing dimensions in the second embodiment.
Figure 10B:
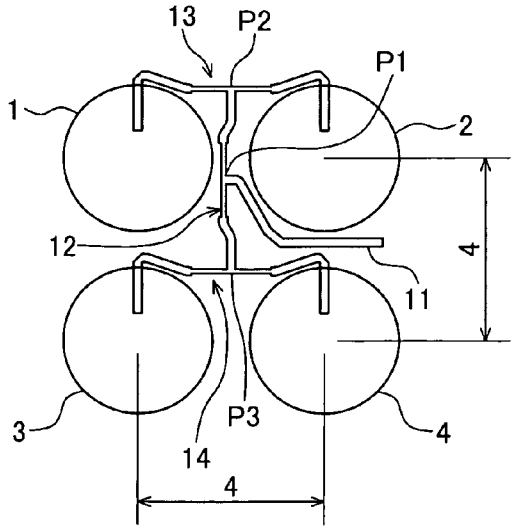
FIG. 10B illustrates antenna element spacing dimensions in the first embodiment.

The result, as shown in FIG. 10A, is that the spacing of the array of radiating elements 1-4 in the second embodiment is reduced to 3.9 mm, which is 0.1 mm less than the 4.0-mm spacing in the first embodiment, shown again for comparison in FIG. 10B. The limiting factor in the array spacing in the second embodiment is now not the space necessary around the first branching point P1, but the space L between the apertures of the second and fourth radiating elements 2, 4 necessary to accommodate the first and fourth striplines 11, 14, as indicated in FIG. 8.

In the second embodiment, the triple junctions at the second and third branching points P2, P3 on the third and fourth striplines 13, 14 have different geometries (Y-shaped and umbrella-shaped). If the distances from the first branching point P1 to the second and third branching points P2, P3 were to be made equal as in the first embodiment, then because of this geometrical difference, the phase of the power fed to the first and second radiating elements 1, 2 would be delayed with respect to the phase of the power fed to the third and fourth radiating elements 3, 4. To align the phases, the first branching point P1 is accordingly placed closer to the second branching point P2 than to the third branching point P3.

Figure 11:
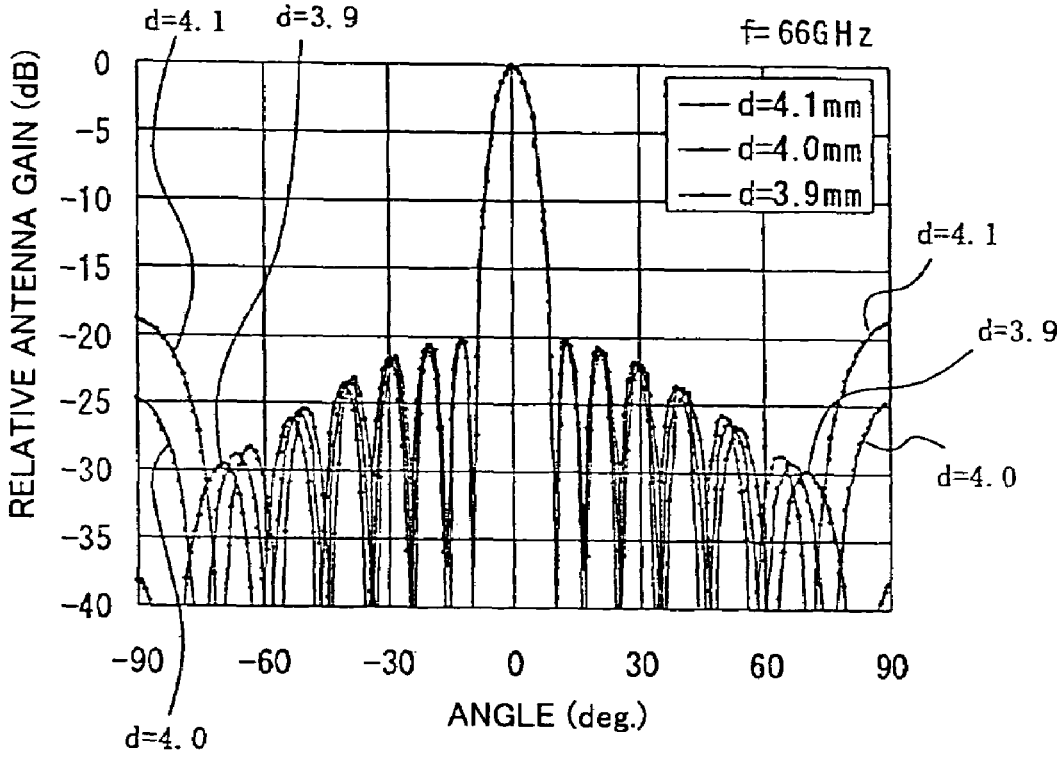
FIG. 11 shows radiation patterns of the antenna using the stripline splitter circuit in the second embodiment.

FIG. 11 shows calculated radiation patterns of flat antennas with 8×8 arrays of radiating elements having spacings of 3.9 mm as in the second embodiment, 4.0 mm as in the first embodiment, and 4.1 mm as conventionally. The frequency of the radiated signal is assumed to be 66 GHz.

As noted previously, grating lobes occur at 90 degrees and −90 degrees with values exceeding −20 dB in the conventional flat antenna with a 4.1-mm spacing, and values less than −20 dB in the antenna with 4.0-mm spacing in the first embodiment. The 3.9-mm spacing used in the second embodiment completely suppresses these grating lobes, further improving the antenna's performance characteristics.

As described above, the V-shaped geometry of the third and fourth striplines 13, 14 in the second embodiment enables the spacing of the array of radiating elements 1-4 to be further reduced, and the power fed to different radiating elements 1-4 is kept in phase by positioning the first branching point P1 closer to the second branching point P2 than to the third branching point P3.

Third Embodiment

Whereas the feeder electrodes that feed power to the radiating elements in the first and second embodiments extend in the negative Y direction, the third embodiment has feeder electrodes extending in the negative X direction, and the basic layout unit is a combination of two antenna units each having four radiating elements.

Figure 12:
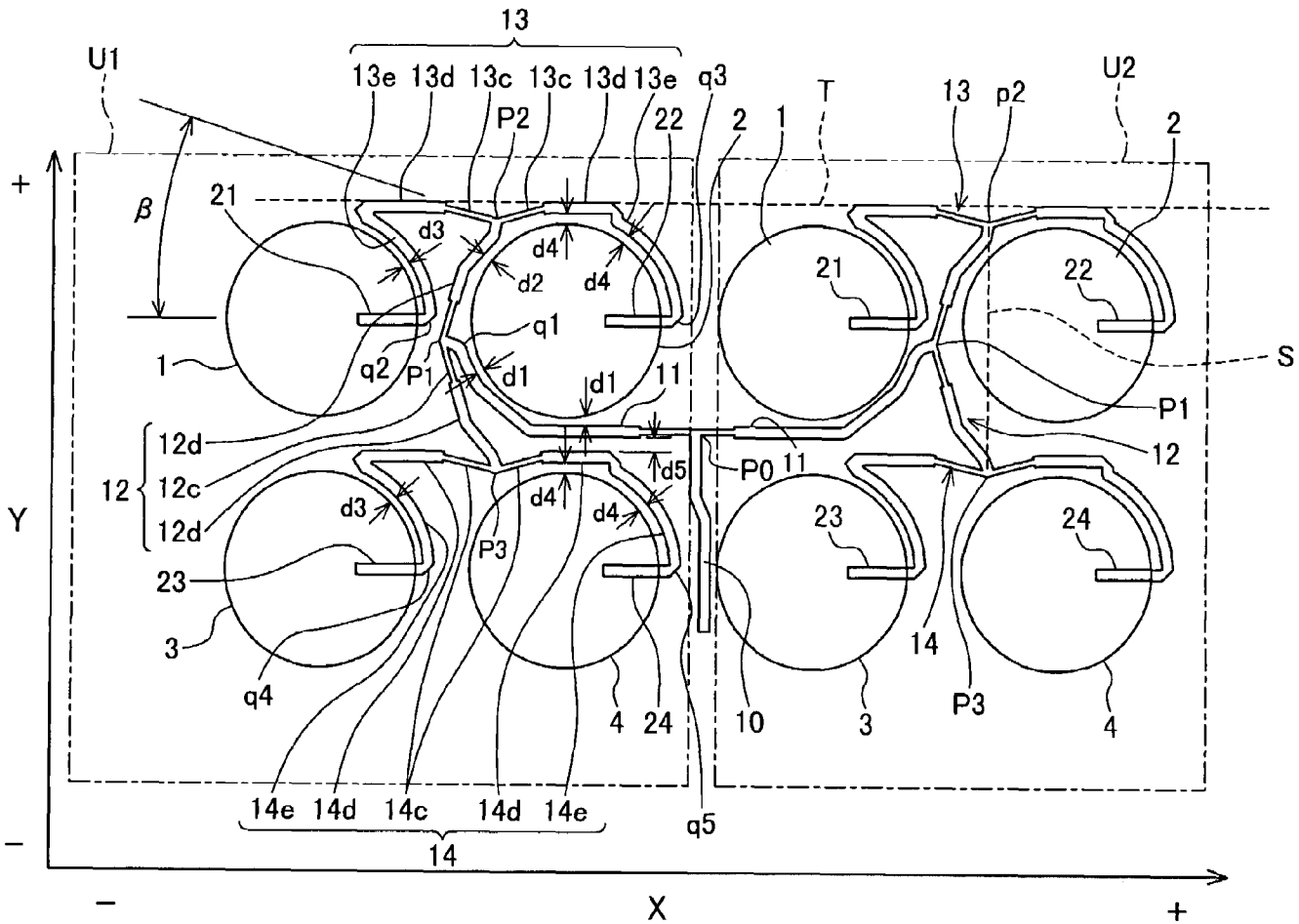
FIG. 12 shows a stripline splitter circuit according to a third embodiment of the invention.

The two antenna units U1, U2, shown in FIG. 12, have substantially identical structures that differ from the second embodiment in regard to the direction of the feeder electrodes 21-24, the shapes of the four striplines 11-14, and the geometry of the first branching point P1. The stripline splitter circuit in antenna unit U1 will be described below; the same description applies to the stripline splitter circuit in antenna unit U2 with a few differences, which will be pointed out.

The first stripline 11 in antenna unit U1 follows the perimeter of the second radiating element 2 partway therearound, maintaining a predetermined distance d1 from the aperture of radiating element 2. In antenna unit U2*s*, the first stripline 11 follows the perimeter of the first radiating element 1 partway therearound, maintaining a similar distance d1 from the aperture of radiating element 1.

The central part 12*c* of the second stripline 12 has a V-shape. In antenna unit U1, the first stripline 11 meets the interior angle of the V; in antenna unit U2, the first stripline 11 meets the exterior angle of the V. The first branching point P1 is thus umbrella-shaped in antenna unit U1 and Y-shaped in antenna unit U2.

The central parts 13*c*, 14*c* of the third and fourth striplines 13, 14 have V-shapes as in the second embodiment. The second branching point P2 is accordingly disposed strictly between the first branching point P1 and an imaginary line T tangent to the third stripline 13 at its uppermost points in the drawing, which are now straight segments 13*d* extending in the X direction. The second and third branching points P2, P3 are disposed near the second and fourth radiating elements 2, 4, and are comparatively distant from the first and third radiating elements 1, 3.

The terminal parts 13*e* of the third stripline 13 follow the perimeters of the first and second radiating elements 1, 2 partway therearound to the connection points q2, q3 with feeder electrodes 21 and 22, maintaining predetermined distances d3, d4 from the apertures of radiating elements 1 and 2. The terminal parts 14*e* of the fourth stripline 14 follow the perimeters of the third and fourth radiating elements 3, 4 partway therearound to the connection points q4, q5 with feeder electrodes 21 and 22, maintaining the predetermined distances d3, d4 from the apertures of radiating elements 3 and 4. The straight segments 13*d*, 14*d* of the third and fourth striplines 13, 14, link the V-shaped central parts 13*c*, 13*d* of these striplines 13, 14 to their terminal parts 13*e*, 14*e*.

In the third embodiment, one terminal part 12*d* of the second stripline 12 follows the perimeter of the second radiating element 2 partway therearound, maintaining a predetermined distance d2 from the aperture of radiating element 2, to meet the exterior angle of the V-shape of the central part 13*c* of the third stripline 13 at the second branching point P2. One arm of the V-shaped central part 13*c* and one straight segment 13*d* of the third stripline 13 also follow the perimeter of the second radiating element 2 partway therearound, maintaining the predetermined distance d4 from the aperture of this radiating element 2. Similarly, one straight segment 14*d* of the fourth stripline 14 substantially follows the perimeter of the fourth radiating element 4, maintaining the predetermined distance d4 from the aperture of the radiating element 4 and the predetermined distance d5 from the first stripline 11.

Because of the V-shapes of the central parts 13*c*, 14*c* of the third and fourth striplines 13, 14, the first branching point P1 is offset in the negative Y direction.

Figure 13A:
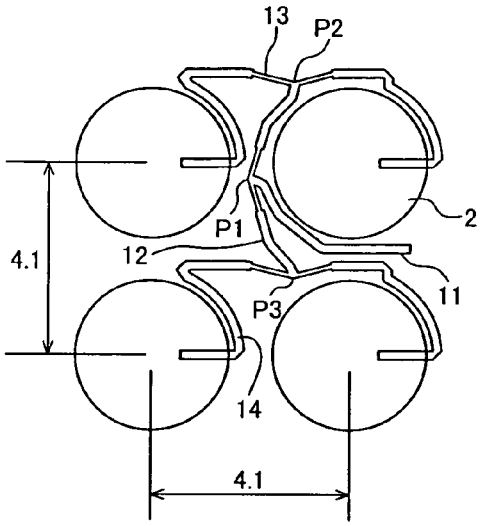
FIG. 13A illustrates antenna element spacing dimensions in the third embodiment.
Figure 13B:
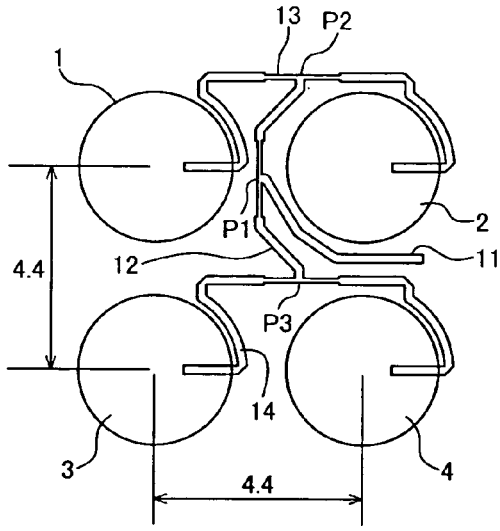
FIG.13B PRIOR ART
FIG. 13B illustrates antenna element spacing dimensions in a similar antenna with a conventional stripline splitter circuit.

If distances d1 to d5 are all 0.12 mm, the radiating elements 1-4 in the third embodiment can be laid out with a 4.1-mm array spacing, as shown in FIG. 13A, which is narrower than the 4.4-mm spacing of the conventional array shown for comparison in FIG. 13B.

As in the second embodiment, to compensate for the different geometries (umbrella-shaped, Y-shaped) of the second and third branching points P2, P3 and align the phase of the power fed to the radiating elements 1-4, the first branching point P1 is placed closer to the second branching point P2 than to the third branching point P3.

In addition, in a pair of mutually adjacent antenna units U1, U2 having their first striplines 11 connected to the same input stripline 10 at an input branching point P0, the input branching point P0 is placed closer to the antenna unit with the Y-shaped first branching point P1 (antenna unit U2 in FIG. 12) than to the antenna unit with the umbrella-shaped first branching point P1 (antenna unit U1), to keep the power supplied to the radiating elements 1-4 in both antenna units U1, U2 mutually aligned in phase. Note that regardless of the phantom lines surrounding the antenna units U1, U2 in FIG. 12, the input branching point P0 is closer to the adjacent radiating elements 1, 3 in antenna unit U2 than to the adjacent radiating elements 2, 4 in antenna unit U1.

The sharp downturn of the first stripline 11 in the immediate vicinity of the first branching point P1 in the third embodiment affects the phase and amplitude of the signal propagating toward the third branching point P3. A compensatory change is therefore made in the widths of the arms of the V-shaped central part 12*c* of the second stripline 12. Specifically, the arm leading toward the second branching point P2 is narrower than the arm leading toward the third branching point P3.

Figure 14:
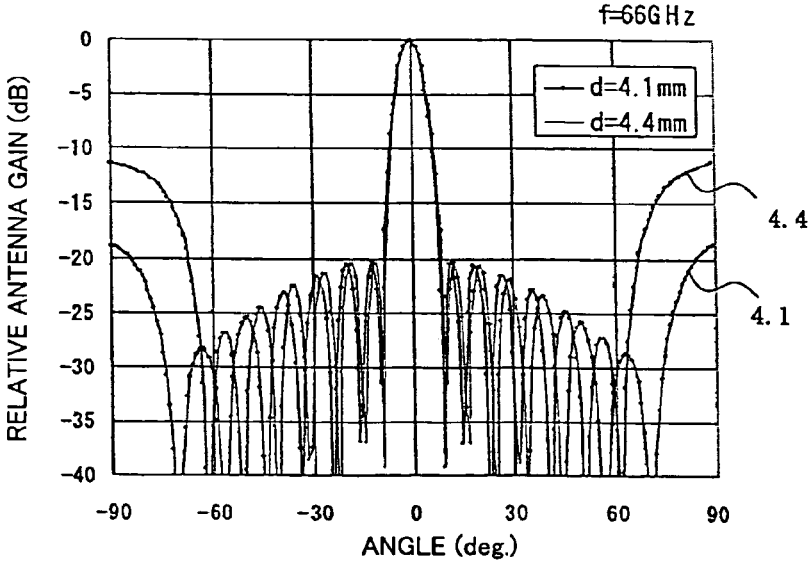
FIG. 14 shows radiation patterns of the antenna using the stripline splitter circuit in the third embodiment.

FIG. 14 shows calculated radiation patterns of flat antennas with 8×8 arrays of radiating elements having spacings of 4.1 mm, as in the third embodiment, and 4.4 mm, as in the conventional antenna in FIG. 2. The frequency of the radiated signal is assumed to be 66 GHz.

In the conventional flat antenna with a 4.4-mm array spacing, large grating lobes, reaching power levels of −11 dB, occur at 90 degrees and −90 degrees. In contrast, in the flat antenna using the 4.1-mm array spacing of the third embodiment, the narrower spacing reduces the grating lobes to approximately −19 dB.

In the third embodiment, all four striplines 11-14 follow the perimeters of the radiating elements 1-4 wherever the layout permits: the first stripline 11 follows the perimeter of the aperture of radiating element 1 or radiating element 2 at a distance d1; the second stripline 12 follows the perimeter of the aperture of radiating element 2 at a distance d2; the third stripline 13 follows the perimeters of the apertures of radiating elements 1 and 3 at distances d3 and d4; the fourth stripline 14 follows the perimeters of the apertures of radiating elements 3 and 4 at distances d3 and d4. The second, third, and fourth striplines 12-14 also have V-shaped central parts. The second stripline 12 joins the third stripline 13 at the exterior angle of the V, and the fourth stripline 14 at the interior angle of the V. The first stripline 11 joins the second stripline 12 at the interior or exterior angle of the V, depending on whether the first stripline 11 follows the perimeter of radiating element 2 or radiating element 1. The first branching point P1 is offset in the negative Y direction, and is closer to the second branching point P2 than to the third branching point P3. The input branching point P0 at which the first striplines 11 of two adjacent antenna units meet an input stripline 10 is closer to the exterior-angle first branching point P1 than to the interior-angle first branching point P1. In combination, these provisions make it is possible to shorten the lengths of the striplines and reduce the array spacing of the radiating elements 1-4 while aligning the phase delays from the power supply point to the radiating elements 1-4.

In the above examples, the radiating elements were circular waveguides with diameters of 3.2 mm, suitable for operation at 66 GHz, but it will be appreciated that the invention is applicable to operation at other wavelengths if the dimensions of the radiating elements are changed.

Further variations are also possible within the scope of the invention, which is defined in the appended claims.

What is claimed is:

1. An antenna using a stripline splitter circuit, the antenna having at least one antenna unit including a first stripline for transmitting electrical power to the radiating elements in the at least one antenna unit formed by first, second, third, and fourth radiating elements disposed in a Cartesian X-Y plane with an X direction and a Y direction orthogonal to the X direction, the radiating elements having respective apertures, the first and second radiating elements being mutually aligned in the X direction, the third and fourth radiating elements being mutually aligned in the X direction, the first and third radiating elements being mutually aligned in the Y direction, the second and fourth radiating elements being mutually aligned in the Y direction, the at least one antenna unit also having first, second, third, and fourth feeder electrodes extending in the Y direction of the Cartesian plane and extending in mutually identical directions into the apertures of the first, second, third, and fourth radiating elements to feed the electrical power to the first, second, third, and fourth radiating elements, respectively, and first, second, third, and fourth striplines for transmitting electrical power to the first, second, third, and fourth radiating elements, the third stripline being connected to the first and second feeder electrodes, the fourth stripline being connected to the third and fourth feeder electrodes, wherein:

the first stripline extends from a first branching point on the second stripline toward the second radiating element, then follows a perimeter of the aperture of the second radiating element partway around the second radiating element, maintaining at least a predetermined distance from the aperture of the second radiating element;

the second stripline includes a straight central part met by the first stripline to form a T-shaped triple junction at the first branching point and terminal parts extending obliquely from respective ends of the straight central part to the imaginary straight line, then extending along the imaginary straight line to meet the second and third branching points, and the second stripline extends from a second branching point on the third stripline to the first branching point, maintaining at least the predetermined distance from the apertures of the first and second radiating elements, then extends from the first branching point to a third branching point on the fourth stripline;

the first branching point is disposed between the first radiating element and an imaginary straight line joining the second and third branching points;

the third stripline has terminal parts that follow respective perimeters of the first and second radiating elements partway around the first and second radiating elements, maintaining at least the predetermined distance from the apertures of the first and second radiating elements, and the third stripline includes a first V- shaped central part with an exterior angle met by the second stripline to form a Y-shaped triple junction at the second branching point, the terminal parts of the third stripline extending from respective ends of the first V-shaped central part of the third stripline;

the fourth stripline has terminal parts that follow respective perimeters of the third and fourth radiating elements partway around the third and fourth radiating elements, maintaining at least the predetermined distance from the apertures of the third and fourth radiating elements and the first stripline, and the fourth stripline includes a second V-shaped central part with an interior angle met by the second stripline to form a triple junction at the third branching point, the terminal parts of the fourth stripline extending from respective ends of the second V-shaped central part of the fourth stripline;

the second branching point is disposed strictly between the first branching point and an imaginary tangent line tangent to the terminal parts of the third stripline; and the first branching point is closer to the second branching point than to the third branching point.

2. An antenna using a stripline splitter circuit, the antenna having at least one antenna unit including a first stripline for transmitting electrical power to the radiating elements in at least one antenna unit formed by first, second, third, and fourth radiating elements disposed in a Cartesian X-Y plane with an X direction and a Y direction orthogonal to the X direction, the radiating elements having respective apertures, the first and second radiating elements being mutually aligned in the X direction, the third and fourth radiating elements being mutually aligned in the X direction, the first and third radiating elements being mutually aligned in the Y direction, the second and fourth radiating elements being mutually aligned in the Y direction, the at least one antenna unit also having first, second, third, and fourth feeder electrodes extending in mutually identical directions into the apertures of the first, second, third, and fourth radiating elements to feed the electrical power to the first, second, third, and fourth radiating elements, respectively, and first, second, third, and fourth striplines for transmitting electrical power to the first, second, third, and fourth radiating elements, the third stripline being connected to the first and second feeder electrodes, the fourth stripline being connected to the third and fourth feeder electrodes, wherein:

the first stripline extends from a branching point on the second stripline toward the second radiating element, then follows a perimeter of the aperture of the second radiating element partway around the second radiating element, maintaining at least a predetermined distance from the aperture of the second radiating element;

the second stripline extends from a branching point on the third stripline to the first branching point, maintaining at least the predetermined distance from the apertures of the first and second radiating elements, then extends from the first branching point to a third branching point on the fourth stripline, and the second stripline has a V-shaped central part met by the first stripline to form a triple junction at the first branching point, and the second stripline has a terminal part extending from the V-shaped central part to follow the perimeter of the second radiating element partway around the second radiating element, maintaining at least the predetermined distance from the aperture of the second radiating element;

the first branching point is disposed between the first radiating element and an imaginary straight line joining the second and third branching points;

the third stripline has terminal parts that follow respective perimeters of the first and second radiating elements partway around the first and second radiating elements, maintaining at least the predetermined distance from the apertures of the first and second radiating elements;

the fourth stripline has terminal parts that follow respective perimeters of the third and fourth radiating elements partway around the third and fourth radiating elements, maintaining at least the predetermined distance from the apertures of the third and fourth radiating elements and the first stripline; and the second branching point is disposed strictly between the first branching point and an imaginary tangent line tangent to the terminal parts of the third stripline.

3. The antenna of claim 2, wherein the first, second, third, and fourth feeder electrodes extend in the X direction of the Cartesian plane.

4. The antenna of claim 3, wherein:

the third stripline has a second V-shaped central part with an exterior angle met by the second stripline to form a triple junction at the second branching point, and a pair of straight segments extending from respective ends of the V-shaped central part to meet the terminal parts of the third stripline at points respectively adjacent the first and second radiating elements; and the fourth stripline has a V-shaped central part with an interior angle met by the second stripline to form a triple junction at the third branching point, and a pair of straight segments extending from respective ends of the V-shaped central part to meet the terminal parts of the fourth stripline at points respectively adjacent the third and fourth radiating elements.

5. The antenna of claim 4, wherein the first branching point is closer to the second branching point than to the third branching point.

6. The antenna of claim 4, wherein each of the V-shaped central parts has a first arm leading toward the second branching point and a second arm leading toward the third branching point, the first arm being narrower than the second arm.

7. An antenna having a pair of antenna units each as described in claim 4, the pair of antenna units including a first antenna unit and a second antenna unit, the first and second antenna units being mutually adjacent in the X direction, the first stripline meeting an interior angle of the V-shaped central part of the second stripline in the first antenna unit, the first stripline meeting an exterior angle of the V-shaped central part of the second stripline in the second antenna unit, the antenna further comprising an input stripline for supplying electrical power to the pair of antenna units, the input stripline being joined to the first striplines in the pair of antenna units at a point closer to the second antenna unit than to the first antenna unit.

* * * * *